US005188881A

United States Patent [19]

Sugiyama et al.

[11] Patent Number: 5,188,881

[45] Date of Patent: Feb. 23, 1993

[54] THERMOSENSITIVE STENCIL PAPER

[75] Inventors: Shoichi Sugiyama, Gotenba; Fumiaki Arai, Mishima; Masayasu Nonogaki; Yuji Natori, both of Numazu; Hideyuki Yamaguchi, Shizuoka; Hitoshi Ueda, Numazu; Hiroshi Tomita; Kotaro Kato, both of Sagamihara, all of Japan

[73] Assignees: Ricoh Company, Ltd., Tokyo; Teijin Ltd., Osaka, both of Japan

[21] Appl. No.: 717,908

[22] Filed: Jun. 20, 1991

[30] Foreign Application Priority Data

Jun. 21, 1990 [JP] Japan ..... 2-161408

[51] Int. Cl.[5] ..... B41M 5/26

[52] U.S. Cl. ..... 428/143; 428/480; 428/516; 428/518; 428/913; 503/200

[58] Field of Search ..... 428/480, 141, 143, 516, 428/518, 323, 913; 503/200

[56] References Cited

U.S. PATENT DOCUMENTS

| | | | |
|---|---|---|---|
| 4,675,233 | 6/1987 | Nakahara et al. | 428/480 |
| 4,853,274 | 8/1989 | Makishima et al. | 428/143 |
| 4,952,449 | 8/1990 | Okazaki et al. | 428/480 |
| 4,957,808 | 9/1990 | Arai et al. | 428/421 |

*Primary Examiner*—Edith Buffalow

*Attorney, Agent, or Firm*—Cooper & Dunham

[57] ABSTRACT

A thermosensitive stencil paper is composed of a substrate and a thermoplastic resin film formed thereon, which thermoplastic resin film has projections in the surface portion thereof, with a printing roughness ($R_p$) of 2.2 to 5.0 μm, which is a physical quantity proportional to the average depth of the depressions in the surface portion thereof pressed against a standard surface.

10 Claims, No Drawings

THERMOSENSITIVE STENCIL PAPER

BACKGROUND OF THE INVENTION

1. Field of the Invention

The present invention relates to a thermosensitive stencil paper for printing, which comprises a porous tissue paper and a thermoplastic resin layer formed thereon, and more particularly to a thermosensitive stencil paper having excellent printing-resistance, capable of producing high quality images with high resolution.

2. Discussion of Background

Conventional thermosensitive stencil paper is prepared by attaching a thermoplastic resin film to a porous substrate such as a porous tissue paper with an adhesive, for example, a pressure-sensitive adhesive, or providing a thermoplastic polymer layer on one side of a porous substrate such as a porous tissue paper.

To make a printing master using the above-mentioned thermosensitive stencil paper, an original is caused to adhere closely to the thermoplastic resin film or the thermoplastic polymer layer of the thermosensitive stencil paper, and infrared rays or light from a xenon flash tube is applied to the porous substrate side of the thermosensitive stencil paper to generate thermal energy at solid image areas of the original. In the thermoplastic resin film or thermoplastic polymer layer, the areas corresponding to the solid image areas of the original which closely adheres to the above resin film or polymer layer are melted by the thermal energy and the porous substrate is exposed at these areas. Thereafter, the original is peeled from the thermosensitive stencil paper to prepare the printing master.

Alternatively, while images formed on the original are read by an image sensor, the thermoplastic resin film or thermoplastic polymer layer of the thermosensitive stencil paper which closely adheres to the original is partially melted to correspond to the solid image areas on the original by the application of the thermal energy from a thermal head.

The thermosensitive stencil paper thus prepared is wound around a printing drum and printing ink is applied thereto from the porous substrate side to be ready for printing.

In the case where the thermoplastic resin film or thermoplastic polymer layer of the thermosensitive stencil paper is partially melted by using the thermal head, part of the melted film or polymer disadvantageously adheres to the surface of the thermal head, which impairs the printing master. Thus, the thermal head needs cleaning periodically. This cleaning operation, however, makes the process for making a printing master more complicated.

There is proposed a thermosensitive stencil paper in which an overcoat layer is formed on a thermoplastic resin film in order to prevent the thermoplastic resin film from sticking to the thermal head during the preparation of a printing master. Unfavorably, however, while thermosensitive stencil papers of that kind are allowed to stand for a while with the substrate of one stencil paper being superimposed on the overcoat layer of the other stencil paper, the resin contained in the overcoat layer migrates to the substrate overlaid thereon, and the desired effect of the overcoat layer cannot be accomplished.

To solve the above problem, various surface-treated thermoplastic resin films for the thermosensitive stencil paper have been developed. For instance, a thermoplastic resin film with a center-line mean roughness (Ra) measured in accordance with JIS B 0601 of 0.01 to 0.3 μm is disclosed in Japanese Laid-Open Patent Application 1-168494, and embossed films for the thermosensitive stencil paper are disclosed in Japanese Laid-Open Patent Applications 51-499 and 51-163598. However, such surface-treated films cannot completely solve the above problem at the present stage.

SUMMARY OF THE INVENTION

Accordingly, an object of the present invention is to provide a thermosensitive stencil paper capable of producing high quality printed images, free from the problems of sticking to the thermal head during the preparation of a printing master, and of the bleeding of an overcoat layer of the thermosensitive stencil paper while it is stored, with other stencil papers overlaid thereon.

The above-mentioned object of the present invention can be achieved by a thermosensitive stencil paper comprising a substrate and a thermoplastic resin film formed thereon, which thermoplastic resin film has projections in the surface portion, with a printing roughness ($R_p$) of 2.2 to 5.0 μm, which is a physical quantity proportional to the average depth of the depressions in the surface portion thereof pressed against a standard surface.

DESCRIPTION OF THE PREFERRED EMBODIMENTS

The thermosensitive stencil paper according to the present invention can be prevented from sticking to the surface of a thermal head during the preparation of a printing master. This is because a thermoplastic resin film of the thermosensitive stencil paper of the present invention has minute projections, with a printing roughness ($R_p$) of 2.2 to 5.0 μm. Furthermore, when an overcoat layer is provided on the thermoplastic resin film, the thermoplastic resin film of this kind can firmly retain the overcoat layer thereon owing to the above-mentioned degree of printing roughness. Therefore, the bleeding of the overcoat layer of the thermosensitive stencil paper does not readily occur while it is stored with the other stencil papers superimposed thereon.

In the case where the printing roughness ($R_p$), in proportion to the average depth of depressions in the surface portion of the thermoplastic resin film pressed against a standard surface, exceeds 5.0 μm, heat conduction becomes nonuniform even though the pressure applied to a platen is increased, which is disposed to face to the thermal head with the stencil paper interposed therebetween. As a result, the areas in the thermoplastic resin film corresponding to the solid image areas of the original which closely adheres to the above resin film cannot be uniformly melted by the thermal energy and the porous substrate is not uniformly exposed at these areas. In addition, the thermal sensitivity of the thermoplastic resin film is lowered, so that clear printed images cannot be obtained.

When the printing roughness ($R_p$), in the surface portion of the thermoplastic resin film is less than 2.2 μm, the overcoat layer cannot firmly be fixed on the thermoplastic resin film, which induces the sticking problem.

In the present invention, the printing roughness in the surface portion of the thermoplastic resin film is measured by a commercially available tester, "Micro Topograph" (Trademark), made by Toyo Seiki Seisaku-sho, Ltd.

This tester measures the physical quantity of printing roughness ($R_p$) which is closely related to the average depth of the depressions in the surface of the stencil paper. In the measurement, the thermosensitive stencil paper is placed on the surface of a prism (standard surface), with a pressure of 1.5 kg/cm$^2$ applied to the stencil paper, to bring the thermoplastic resin film of the stencil paper in close contact with the prism. A parallel beam of light is applied to the surface of stencil paper through the prism.

The phenomenon in which the light that must be totally reflected by the surface of the thermoplastic resin film transmits to the film through the air gap between the prism and the resin film is known as Frustrated Total Reflection (FTR). In this case, the stencil paper and the prism are regarded to be optically in contact though they are not actually in contact. By utilizing this phenomenon and determining the fractional value of optical contact area by varying the wavelength of light, the extent of occupancy of the thermoplastic resin film within a certain depth from the surface of the prism corresponding to each wavelength can be determined, and the surface properties of the thermoplastic resin film can be estimated from the relationship between the wavelength λ and the fractional value of optical contact area F(λ).

$$F(\lambda) = 1 - \frac{\Phi(\lambda)}{\Phi_o(\lambda)}$$

In the above formula, λ represents a wavelength; $\phi_o$, the amount of incident light; Φ, the amount of reflected light; and F, the fractional value of optical contact area.

Then, the printing roughness ($R_p$) can be obtained in accordance with the following formula:

$$R_p = \int_0^{\infty} [1 - F(\lambda)]d\lambda$$

In the above formula, d represents a depth from the surface of the prism to the surface of the stencil paper.

For the thermoplastic resin film, vinyl chloride resin, vinylidene chloride copolymer resin, polypropylene resin and polyester resin can be employed in the present invention.

Of these resins, a polyester resin is particularly preferable. The polyester resin used as the thermoplastic resin film is not limited as far as it has an ester linkage therein. Respective examples of the component of an acid include aromatic dicarboxylic acids such as terephthalic acid, isophthalic acid, 2,6-naphthalenedicarboxylic acid, α,β-bis(2-chlorophenoxy)ethane-4,4-dicarboxylic acid and sodium 5-sulfoisophthalate; aliphatic dicarboxylic acids such as sebacic acid, adipic acid and dodecadionic acid.

Specific examples of a diol component for the above-mentioned polyester resin are polyesters having ethylene glycol, diethylene glycol, 1,4-butanediol, polyethylene glycol and polytetramethylene glycol, and mixtures thereof. Of these, aromatic polyesters are preferred.

It is preferable that the thickness of the thermoplastic resin film be in the range of 0.5 to 3.5 μm, and more preferably in the range of 1.0 to 2.5 μm, when measured by an ordinary thickness meter, in order to cause a predetermined portion of the thermoplastic resin film to be melted accurately corresponding to the solid image area of the original.

The thermoplastic resin film of the thermosensitive stencil paper of the present invention can be prepared by the conventional methods, preferably, prepared in the form of a biaxially oriented film.

For example, an aromatic polyester resin is sufficiently dried at the predetermined temperature, and then placed in a hopper of an extruder.

The molten polyester resin is extruded through a slit die of the extruder on a rotating cooling drum, so that it is rapidly cooled to be set. Thus, a disoriented film is obtained. The thus obtained disoriented film is oriented to a lengthwise direction and a crosswise direction sequentially. Thereafter, the film is subjected to heat treatment at a predetermined temperature, generally in the range of 100° to 250° C., to obtain a biaxially oriented film. It is preferable that the percent of stretch of a film be 2.5 to 5 times in both the lengthwise direction and crosswise direction.

The printing roughness ($R_p$) of the thermoplastic resin film for use in the present invention, which is not necessarily correlated with the surface roughness, for instance, the center-line mean roughness (Ra) as defined in JIS B 0601, depends upon the size, the shape, the number and the distribution of the projections provided on the thermoplastic resin film. For example, if the shape of the projections is not sharp and they show a broad distribution as a whole even though each projection is high, the printing roughness ($R_p$) of the thermoplastic resin film does not reach the values defined in the present invention.

The reason why the factors of the shape and the distribution of the projections have an important effect on the printing roughness ($R_p$) of the thermoplastic resin film is that the printing roughness ($R_p$) is determined by the contact condition, that is, the thickness of an air gap between the thermoplastic resin film and the other surface of a substance when the resin film is brought into contact with the above-mentioned substance. Namely, when the thermoplastic resin film having sharp projections which are uniform in size is brought into contact with the other surface, the thermoplatic resin film touches the other surface at the points of the projections, so that the average thickness of the air gap formed between the thermoplastic resin film and the other surface is increased. Consequently, in this case, the printing roughness ($R_p$) of the thermoplastic resin film is increased.

The projections can be formed in the surface of the thermoplastic resin film for use in the present invention when inactive finely-divided particles are contained in the thermoplastic resin film. It is preferable such inactive finely-divided particles have an average particle diameter of 0.5 to 4 μm, more preferably in the range of 0.8 to 3.5 μm, and further preferably in the range of 1.0 to 3 μm, with the ratio of the longer diameter to the shorter diameter of a particle ranging from 1.0 to 1.3.

In addition, the inactive finely-divided particles for use in the present invention are substantially spherical particles with the relative standard deviation of the particle diameter represented by the following formula being 0.5 or less:

Relative standard deviation of the particle diameter =

$$\sqrt{\sum_{i=1}^{n} (Di - \overline{D})^2/n} \quad /\overline{D}$$

wherein Di represents the diameter (μm) of the circle obtained by projecting each particle onto a plane; D represents the average particle diameter (μm) of the circle obtained by projecting the particle onto a plane, that is, $$\left(\sum_{i=1}^{n} Di\right)/n;$$

and n is the number of particles.

Examples of the inactive finely-divided particles for use in the thermoplastic resin film include spherical silica, spherical silicone resin, spherical crosslinked polystyrene and spherical crosslinked acrylic resin. The inactive finely-divided particles may be preferably contained in the thermoplastic resin film in an amount of 0.05 to 3 wt. %.

When the above-mentioned inactive finely-divided particles are contained in the thermoplastic resin film and, at the same time, the thermoplastic resin film is prepared in the form of a biaxially oriented film by the aforementioned method, the thermoplastic resin film with the desired printing roughness ($R_p$) can be obtained in the present invention.

For the porous substrate of the thermosensitive stencil paper according to the present invention, which is not particularly limited, synthetic fiber such as polyester, vinylon and nylon; and natural fiber such as Manila hemp, Broussonetia, Edgeworthia chrysantha are employed singly or in combination. The basis weight of the porous substrate is generally 5 to 15 g/m$^2$.

The thermoplastic resin film is attached to the porous substrate with an adhesive, for example, polyester resin, polyvinyl acetate resin, ethylene—vinyl acetate copolymer resin, chlorinated polypropylene resin, polyacrylate resin, terpene resin, butadiene-styrene rubber (SBR), acrylonitrile-butadiene-styrene (ABS) resin, polyvinyl ether and polyurethane.

Examples of the material for the overcoat layer provided to prevent the sticking problem include silicone resin, fluorine-containing resin, silicone oil and a variety of surface active agents. These are not limited to the above materials in the present invention.

Other features of this invention will become apparent in the course of the following description of exemplary embodiments, which are given for illustration of the invention and are not intended to be limiting thereof.

EXAMPLE 1

Manganese acetate serving as an ester interchange catalyst, antimony trioxide serving as a polymerization catalyst, phosphorus acid serving as a stabilizer and 0.4 wt. % of spherical silica particles, serving as a lubricant, which have an average particle diameter of 1.5 μm (with the ratio of the longer diameter to the shorter diameter of 1.15) were dispersed in a mixture of dimethyl terephthalate and ethylene glycol. This mixture underwent the ester interchange and condensation polymerization. Thus, polyethylene terephthalate (PET) with an intrinsic viscosity of 0.65 was prepared.

A pellet of the above-prepared PET was dried at 170° C. for 3 hours, and then placed in a hopper of an extruder.

In the hopper, PET was melted at temperatures of 280° to 300° C. The molten polymer was cast through a slit die on a rotating drum with a surface temperature of 20° C., which has been finished so as to be approximately 0.3 S, so that a disoriented film was obtained.

The thus obtained disoriented film was oriented 3.9 times to a lengthwise direction at 90° C., and the film was introduced into a film-making apparatus and oriented 4.0 times to a crosswise direction at 95° C. Thereafter, the film was subjected to heat treatment at 220° C. for 5 seconds, so that a biaxially oriented film with a film thickness of 2.0 μm was obtained.

The above biaxially oriented film and a sheet of Japanese paper made of Manila hemp with a basis weight of 11 g/m$^2$, serving as a porous substrate, were laminated with a copolymer of vinyl chloride and vinyl acetate in a deposition amount of 1.0 g/m$^2$ on a dry basis.

On the above-prepared PET film, opposite side to the porous substrate, an overcoat layer was formed, with a solid content thereof being 0.1 g/m$^2$.

Thus, a thermosensitive stencil paper No. 1 according to the present invention was prepared.

The above thermosensitive stencil paper No. 1 was wound around a drum of a commercially available printing machine, "Priport SS 950" (Trademark), made by Ricoh Company, Ltd., to prepare a printing master and an image formation test was carried out using the thus prepared printing master.

The results are shown in Table 1.

EXAMPLE 2

The procedure for preparation of the thermosensitive stencil paper No. 1 according to the present invention employed in Example 1 was repeated except that spherical silica particles with an average particle diameter of 2.5 μm was contained as a lubricant in the composition of the thermoplastic resin film in an amount of 0.3 wt. %, so that thermosensitive stencil paper No. 2 according to the present invention was prepared.

Using the above-prepared thermosensitive stencil paper, the printing master was prepared and the image formation test was carried out in the same manner as in Example 1.

The results are shown in Table 1.

COMPARATIVE EXAMPLE 1

The procedure for preparation of the thermosensitive stencil paper No. 1 according to the present invention employed in Example 1 was repeated except that calcium carbonate particles with an average particle diameter of 1.2 μm was contained as a lubricant in the composition of the thermoplastic resin film in an amount of 0.4 wt. %, so that comparative thermosensitive stencil paper No. 1 was prepared.

Using the above-prepared comparative thermosensitive stencil paper, the printing master was prepared and the image formation test was carried out in the same manner as in Example 1.

The results are shown in Table 1.

COMPARATIVE EXAMPLE 2

The procedure for preparation of the thermosensitive stencil paper No. 1 according to the present invention employed in Example 1 was repeated except that porous silica particles having an average particle diameter of 3.0 μm (with a ratio of the longer diameter to the shorter diameter of 10) was contained as a lubricant in the composition of the thermoplastic resin film in an amount of 0.5 wt. %, so that comparative thermosensitive stencil paper No. 2 was prepared.

Using the above-prepared comparative thermosensitive stencil paper, the printing master was prepared and the image formation test was carried out in the same manner as in Example 1.

The results are shown in Table 1.

TABLE 1

| | Thickness of PET Film (μm) | Center-line Mean Roughness [Ra] (μm) | Printing Roughness of Thermoplastic Resin Film (μm) | Sticking Resistance (*) | Retention of Overcoat Layer (%) (**) | Printed Image Quality (***) |
|---|---|---|---|---|---|---|
| Ex. 1 | 2.0 | 0.038 | 2.5 | ◎ | 65 | ◎ |
| Ex. 2 | 1.9 | 0.033 | 3.3 | ◎ | 75 | ◎ |
| Comp. Ex. 1 | 2.1 | 0.035 | 1.7 | X | 35 | X |
| Comp. Ex. 2 | 2.1 | 0.055 | 6.0 | ○ | 90 | X |

(*) The sticking resistance was evaluated in accordance with the following scale:
◎ — the sticking noise did not occur and dot-images corresponding to original images were reproduced very clearly and accurately.
○ — the sticking noise did not occur and the reproduced dot-images corresponding to original images were satisfactory for practical use.
X — the sticking noise was striking and the reproduction of dot-images corresponding to the original images was poor. In addition, the overcoat layer was peeled off the thermoplastic resin (PET) film.
(**) The residues of the overcoat layer was measured by using fluorescent X-rays and the retention of the overcoat layer was expressed by the following formula:

$$\text{Retention of Overcoat Layer (\%)} = \frac{\text{Residues of Overcoat Layer}}{\text{Deposition Amount of Overcoat Layer when coated}} \times 100$$

(***) The image formation test was carried out and the printed image quality was evaluated in accordance with the following scale:
◎ — the reproduction, resolution and sharpness of dot-images was excellent.
X — the resolution and sharpness of dot-images were poor.

As can be seen from the results in Table 1, the thermosensitive stencil papers of the present invention do not cause the sticking problem during the preparation of printing masters.

In addition, when the printing operation is carried out by using the thus prepared printing masters, high quality printed images can be obtained.

Furthermore, even when the thermosensitive stencil papers are allowed to stand with a porous substrate of the upper stencil paper coming in contact with an overcoat layer of the lower stencil paper, the overcoat layer of the lower stencil paper does not readily bleed to the substrate of the upper stencil paper.

What is claimed is:

1. A thermosensitive stencil paper comprising a substrate and a thermoplastic resin film formed thereon, which thermoplastic resin film has projections in the surface portion thereof, with a printing roughness ($R_p$) of 2.2 to 5.0 μm, which is a physical quantity proportional to the average depth of the depressions in the surface portion thereof pressed against a standard surface.

2. The thermosensitive stencil paper as claimed in claim 1, wherein said thermoplastic resin film is a biaxially oriented film.

3. The thermosensitive stencil paper as claimed in claim 1, wherein said thermoplastic resin film comprises a thermoplastic resin and inactive finely-divided particles.

4. The thermosensitive stencil paper as claimed in claim 3, wherein said thermoplastic resin for said thermoplastic resin film is selected from the group consisting of vinyl chloride resin, vinylidene chloride copolymer resin, polypropylene resin and polyester resin.

5. The thermosensitive stencil paper as claimed in claim 3, wherein the material for said inactive finely-divided particles for said thermoplastic resin film is selected from the group consisting of spherical silica, spherical silicone resin, spherical crosslinked polystyrene and spherical crosslinked acrylic resin.

6. The thermosensitive stencil paper as claimed in claim 3, wherein said inactive finely-divided particles have an average particle diameter of 0.5 to 4 μm, with the ratio of the longer diameter to the shorter diameter of each of said particles ranging from 1.0 to 1.3.

7. The thermosensitive stencil paper as claimed in claim 3, wherein said inactive finely-divided particles have a relative standard deviation of 0.5 or less in the particle diameter thereof when represented by formula (I):

$$\sqrt{\sum_{i=1}^{n} (Di - \overline{D})^2/n} \quad /\overline{D} \qquad \text{(I)}$$

wherein Di represents the diameter (μm) of the circle obtained by projecting each particle onto a plane; $\overline{D}$ represents the average particle diameter (μm) of the circle obtained by projecting the particle onto a plane; and n is the number of particles.

8. The thermosensitive stencil paper as claimed in claim 3, wherein said inactive finely-divided particles are contained in said thermoplastic resin film in an amount of 0.05 to 3 wt. %.

9. The thermosensitive stencil paper as claimed in claim 1, wherein said thermoplastic resin film has a thickness of 0.5 to 3.5 μm.

10. The thermosensitive stencil paper as claimed in claim 1, further comprising an overcoat layer which is provided on said thermoplastic resin film.

* * * * *